US008739349B2

(12) United States Patent
Bryan

(10) Patent No.: US 8,739,349 B2
(45) Date of Patent: Jun. 3, 2014

(54) VERSATILE FLEXIBLE SCRUBBER BRUSH

(76) Inventor: George R. Bryan, Vero Beach, FL (US)

( * ) Notice: Subject to any disclaimer, the term of this patent is extended or adjusted under 35 U.S.C. 154(b) by 139 days.

(21) Appl. No.: 13/178,756

(22) Filed: Jul. 8, 2011

(65) Prior Publication Data

US 2012/0005854 A1 Jan. 12, 2012

Related U.S. Application Data

(60) Provisional application No. 61/362,425, filed on Jul. 8, 2010.

(51) Int. Cl.
*B63B 59/06* (2006.01)

(52) U.S. Cl.
USPC ..... 15/160; 15/206; 114/222

(58) Field of Classification Search
CPC .. B63B 59/06; B63B 59/08; B63B 2059/087; B08B 1/002
USPC ..... 15/206–207.2, 159.1, 160, 104.2, 15/104.33, 104.05; 57/210, 232; 114/222
See application file for complete search history.

(56) References Cited

U.S. PATENT DOCUMENTS

| | | | | |
|---|---|---|---|---|
| 336,149 | A | 2/1886 | Noyes | |
| 623,698 | A | 4/1899 | Beckh | |
| 1,628,023 | A | 11/1926 | Adkins | |
| 1,864,379 | A | 10/1930 | Tailor | |
| 2,318,680 | A | 1/1942 | Ellinger | |
| 2,505,610 | A | 6/1946 | Ellinger | |
| 2,639,532 | A | 2/1952 | Seewaid | |
| 2,905,957 | A | 11/1956 | Volpe | |
| 2,913,756 | A | 3/1957 | MacFarland | |
| 3,063,081 | A | 9/1961 | Brown | |
| 3,124,823 | A * | 3/1964 | Charvat | 15/206 |
| 3,130,441 | A | 4/1964 | Hahn | |
| 3,325,845 | A * | 6/1967 | Wasyl Sawkiw | 15/207.2 |
| 3,935,611 | A | 2/1976 | Locher | |
| 3,936,198 | A | 2/1976 | Martin | |
| 4,281,832 | A | 8/1981 | Quinby, Jr. | |
| 4,648,344 | A | 3/1987 | Burgers et al. | |
| 4,761,945 | A * | 8/1988 | Bunger | 57/224 |
| 4,909,173 | A | 3/1990 | Strong | |
| 4,974,279 | A | 12/1990 | Mathison | |
| 5,067,384 | A * | 11/1991 | Scala | 87/6 |
| 5,732,541 | A * | 3/1998 | Kunzelman | 57/7 |
| D454,003 | S * | 3/2002 | Saxon | D4/131 |
| 6,574,819 | B1 * | 6/2003 | Ratcliffe | 15/1 |
| 2010/0175213 | A1 * | 7/2010 | Fitzwater | 15/160 |

FOREIGN PATENT DOCUMENTS

| | | |
|---|---|---|
| JP | 5-170177 | * 12/1991 |
| WO | WO 97/41026 | * 11/1997 |

* cited by examiner

*Primary Examiner* — Laura C Guidotti
(74) *Attorney, Agent, or Firm* — Cynthia V. Hall; VanDeVoorde Hall Law, P.L.; Robert Allen Lynch

(57) ABSTRACT

A versatile, flexible scrubbing apparatus comprising a rope having a first end and a second end wherein the rope may comprise one or more twisted strands wherein one or more filaments may be captured between the one or more strands and/or twists of the rope. The one or more filaments may be positioned essentially perpendicular or at predetermined angles to the length of rope. A handle may be attached to both the first and second end of the rope, wherein user manipulation of the handles may act to pull the rope across the bottom surface of a boat to clean the hull.

10 Claims, 4 Drawing Sheets

VERSATILE FLEXIBLE SCRUBBER BRUSH

CROSS REFERENCE TO RELATED APPLICATIONS

This application claims the benefit of provisional patent application Ser. No. 61/362,425, filed with the USPTO on Jul. 8, 2010, which is herein incorporated by reference in its entirety.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The present invention generally relates to a rope that can be strategically weighted. The rope has filaments captured between the twisted strands forming the rope or applied within its core. The filaments may be selected such that the rope may be used as a cleaning and scrubbing apparatus or brush.

2. Background Art

The problem of removing marine growth from the surfaces of boat hulls has been a problem that has existed for as long as boats have been plying large bodies of salt water. Marine growth on the hulls of commercial and recreational boats can seriously affect the efficiency of the boat hull in the water, and must therefore be removed periodically to use the vessel efficiently and economically. There are various types of marine growth, one form being a type of scum or slime that attaches itself to wide expanses of underwater hull surfaces, while other types of marine growth include barnacle-like creatures that attach themselves to the hull and form a protrusion from the outer surface of the boat hull that has a very detrimental effect on the speed and fuel economy that may be achieved by the boat in the water.

Boats can be removed from the water to facilitate cleaning the underside. However, this is often a costly and time consuming operation. Therefore, it is an object of the present invention to provide an apparatus for cleaning the underside of a boat hull which does not require the boat to be removed from the water.

A person can enter the water to clean the underside of the boat. However, this can be a dangerous, time consuming, or unpleasant task for many. Therefore, it is a further object of the present invention to provide an apparatus for cleaning the underside of a boat while the person or people doing the cleaning remain out of the water.

One of the problems that is frequently encountered with scrubbing devices for scrubbing the underside of boat hulls is the strength and stamina that must be possessed by the person operating the scrubbing device. Many such devices are makeshift and require manipulation by a strong man, accustomed to doing that type work. For example, U.S. Pat. No. 4,648,344 utilizes a flexible sheet of relatively thin material on one side of which is provided a means for scrubbing while the opposite surface thereof are provided a multiplicity of floatation devices so that when the device is submerged say, for instance, below a boat hull submerged in the water, the floatation means on the strip function to provide an upward component of force on the strip, causing it to plaster itself against the surface of the boat hull. A handle connected to the elongated sheet may then be manipulated to reciprocate the sheet while in contact with the boat hull.

Accordingly, a still further object of the present invention is the provision of a scrubbing device that may be manipulated by even a small person unaccustomed to manipulating a scrubbing device of any kind. When a boat hull is submerged and it is attempted to scrub the submerged surface, it is necessary that the scrubbing device be pressed forcefully against the fouled boat surface and manipulated, usually by reciprocation, to abrade the surface to remove the marine growth thereon. One method of course is to utilize a long, stiff and rigid handle on one end of which is attached the abrading means. Using the long, stiff and rigid handle as a lever, the operator can exert a certain amount of force on the boat hull with the abrading device and when the device is reciprocated, the marine growth will be removed. The difficulty with such a device is that most boat hulls are contoured to provide curved surfaces and the utilization of such a stiff and rigid device does not enable the cleaning of such contoured surfaces. Accordingly, another object of the present invention is the provision of a scrubbing device for contoured boat hulls in which the scrubbing surface is flexible, enabling the scrubbing device to follow the contoured boat hull.

The invention possesses other objects and features of advantage, some of which, with the foregoing, will be apparent from the following description and the drawings. It is to be understood however that the invention is not limited to the embodiment illustrated and described since it may be embodied in various forms.

BRIEF SUMMARY OF THE INVENTION

The present invention is directed to an apparatus for cleaning a boat hull.

An object of the present invention is to allow a user to clean the underside of a boat while the boat remains in the water.

Another object of the present invention is to provide a boat hull cleaning apparatus that can be used by one or more people aboard the boat to be cleaned.

In accordance with one embodiment of the present invention, a scrubber device comprising a rope having a first end, a second end, and an outer surface, and one or more filaments, wherein the one or more filaments extend outward from the outer surface of the rope.

In accordance with another embodiment of the present invention, a scrubber device, comprising a rope having a first end, a second end, and an outer surface, the rope further comprising one or more weighted components; a core, wherein the core is disposed about the one or more weighted components; and one or more strands, wherein the one or more strands are twisted together about the core; one or more filaments, wherein the one or more filaments extend outward from the outer surface of the rope; and a handle attached to the first end and/or the second end of the rope.

In accordance with one embodiment of the present invention, a scrubber device, comprising a rope having a first end, a second end, and an outer surface, the rope further comprising one or more weighted components; a core, wherein the core is disposed about the one or more weighted components; and one or more strands, wherein the one or more strands are twisted together about the core; one or more filaments, wherein the one or more filaments extend outward from the outer surface of the rope, the one or more filaments further comprising one or more flagged ends thereon; and a handle attached to the first end and/or the second end of the rope; wherein each of the one or more filaments comprise a diameter in the range of 0.006 inches to 0.100 inches; and wherein each of the one or more filaments extend from the outer surface of the rope a distance in the range of 0.5 inches to 12.0 inches

BRIEF DESCRIPTION OF THE DRAWINGS

A better understanding of the present invention will be realized from the detailed description that follows, taken in conjunction with the accompanying drawings, in which.

DETAILED DESCRIPTION OF THE INVENTION

Although the following detailed description contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention.

Figure 1:
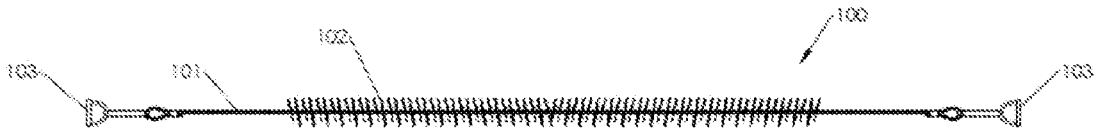
FIG. 1 depicts a top view of an embodiment of a device of the present invention.

FIG. 1 depicts one embodiment of the versatile flexible scrubber device 100, wherein one exemplary embodiment may comprise a rope 101 impregnated with one or more filaments 102 and optionally having at least one handle 103 at one or both ends of the rope 101. The rope 101 may comprise one or more strands 107 of material that may be twisted, braided, or otherwise joined together (see FIG. 2). As further shown in FIG. 2, the rope 101 may have a core 106 made of various materials, including but not limited to, stainless steel, plastic, polyethylene, polyethylene foam, expanded polyethylene, any combination thereof, or the like, which may be included to add, enhance, or modify buoyancy. The density of the core 106 may be varied based upon the desired application of the finished device 100. For example, if the device 100 will be used to clean a boat with a deep draft, the core 106 may comprise less buoyant material to facilitate positioning the device 100 beneath the hull of the vessel. When the device 100 is to be used on vessels with shallower drafts, the core 106 may comprise more buoyant material to increase the upward pressure on the hull. This upward pressure caused by the buoyancy of the rope 101 acts to facilitate cleaning.

Figure 2:
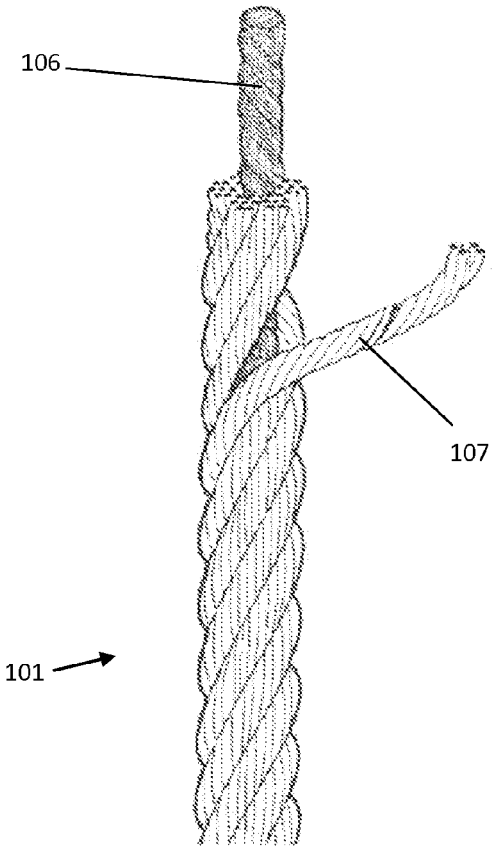
FIG. 2 depicts a magnified perspective view of an embodiment of a device of the present invention.

As shown in FIG. 2, one or more strands 107 may surround the core 106. Each of the one or more strands 107 may be comprised of a plurality of lengths of various materials that may be used to construct the rope 101. Preferred embodiments of a finished rope 101 may comprise three (3) strands, eight (8) strands, any number of strands known within the art, and the like, while the scope of the present invention further includes any number of strands 107. Each of the one or more strands 107 may comprise material such as but not limited to wire, cotton, Kevlar, manila hemp, hemp, linen, coir, jute, sisal, polypropylene, nylon, polyesters, polyethylene, polyaramids, aramids, rayon, metal, or the like. FIG. 2 depicts how one or more strands 107 may be wrapped around a core 106 to form a rope 101. In ropes 101 constructed as shown in FIG. 2, there may be one or more weighted components 105 (see FIG. 3) within the core 106.

Figure 3:
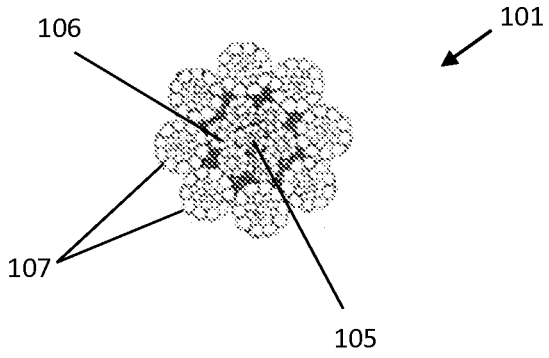
FIG. 3 depicts a cross-section of an embodiment of a device of the present invention.

FIG. 3 depicts a cross-section of rope 101 further comprising one or more weighted components 105 surrounded by a core 106, and thereafter one or more strands 107 of material surrounding the core 106. In alternate embodiments, the one or more weighted components 105 may be surrounded by one or more strands 107 comprising the rope 101 and a core 106 may be optional. Additionally, in alternate embodiments, the one or more weighted components 105 may be optional and the rope 101 may comprise one or more strands 107 and a core 106. In yet other embodiments, the rope 101 may comprise only the one or more strands 107, only the core 106, only one or more weighted components 105, or any combinations thereof.

Figure 4:
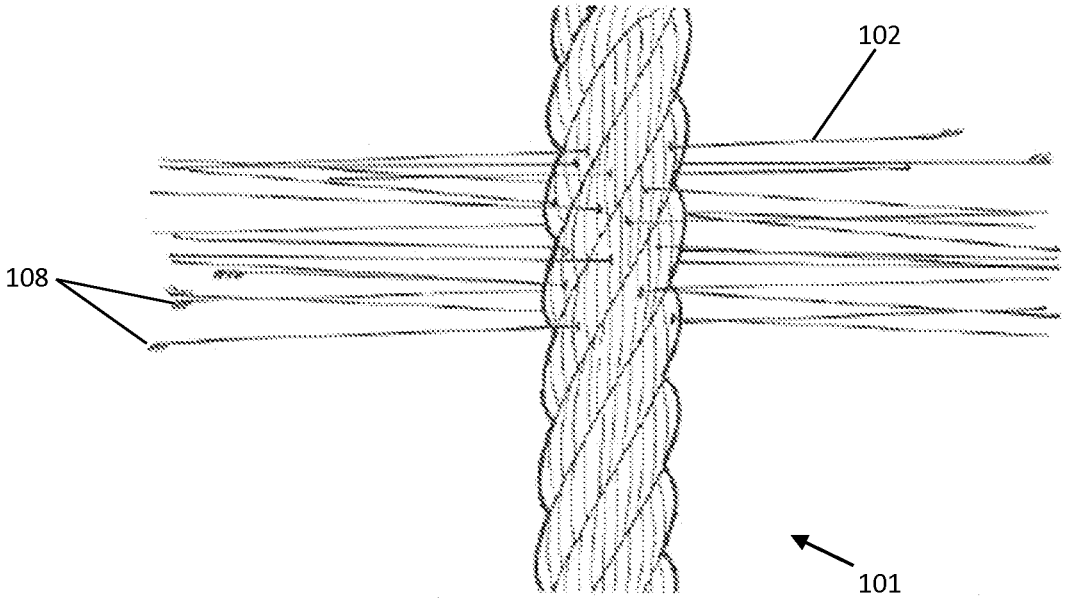
FIG. 4 depicts a magnified side view of an embodiment of a device of the present invention.
Figure 5:
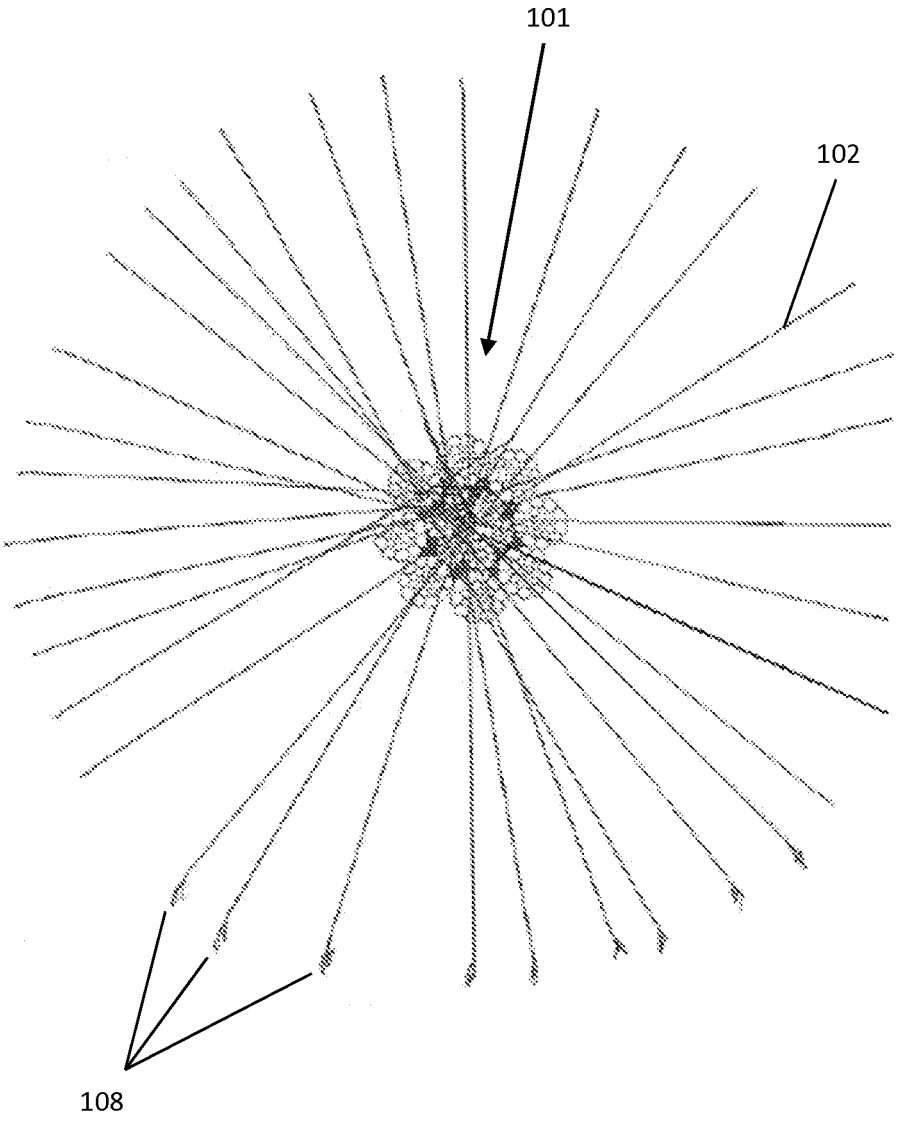
FIG. 5 depicts a cross-section view of an embodiment of a device of the present invention.

As depicted in FIG. 4, preferred embodiments may comprise a rope 101 having one or more strands 107 twisted together and one or more filaments 102 may be captured between or through the one or more strands 107 or inserted within the inner core 106 of the rope 101. The one or more filaments 102 may be oriented either perpendicular or at any other angle (e.g. ranging from zero degrees to ninety degrees) relative to the length of rope 101 and placed either between the one or more strands 107, within the inner core 106, or even within the one or more weighted components 105. FIG. 5 depicts a cross-section of one embodiment of rope 101 having one or more filaments 102 retained between strands wherein each end of the one or more filaments 102 protrudes past the outer surface or diameter of the rope 101. The length, thickness, rigidity, and other similar features of the one or more filaments 102 may be selected based upon the intended use of the particular versatile flexible scrubber device 100. The one or more filaments 102 may be constructed from material(s) including but not limited to polybutylene terephthalate polyester, polypropylene, polystyrene, nylon, polyester, or the like. In preferred embodiments, the one or more filaments 102 may absorb little water and hold their stiffness when exposed to moisture. The one or more filament 102 material and dimensions may be selected to match the abrasive characteristics of the filaments to the particular application for which the device 100 is to be used. The one or more filaments 102 may have a cross section shape including but not limited to round, oval, crosshairs, square, and the like or as known in the art. The one or more filaments 102 may preferably range in diameter from 0.006 inches to 0.100 inch and may preferably range in length from as small as the diameter of the rope 101 to as long as twelve (12) inches from the center point of the cross-section of the rope 101. Different filaments 102 captured by the same rope 101 may have different properties. The one or more filaments 102 may be secured to the rope 101 by compression between the one or more strands 107. The one or more filaments 102 may also, or in the alternative, be secured to the rope 101 with an adhesive or fused to the rope 101. These techniques may be used in any combination or used separately.

As shown in FIGS. 4-5, the one or more filaments 102 may further comprise one or more flagged ends 108 in order to enhance the abrasive or cleaning efficiencies and qualities of the one or more filament 202 and thereby the device 100 itself FIG. 4 depicts a rope 101 through which one or more filaments 102 have been inserted. The one or more filaments 102 depicted therein further comprise one or more flagged ends 608.

Figure 6:
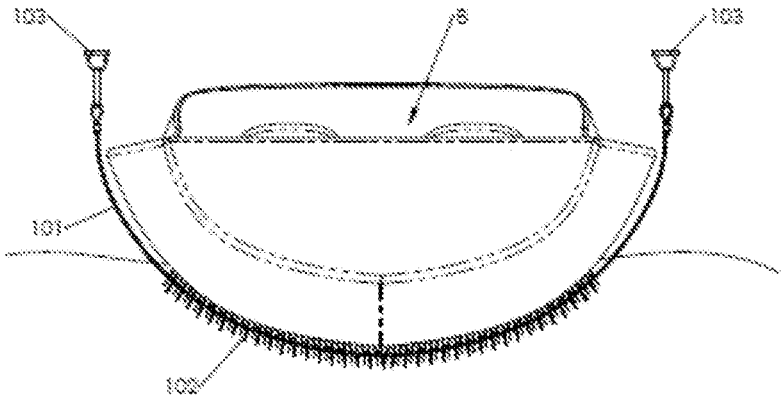
FIG. 6 depicts a rear view of a boat while an embodiment of a device of the present invention is disposed beneath the hull of a boat.
Figure 7:
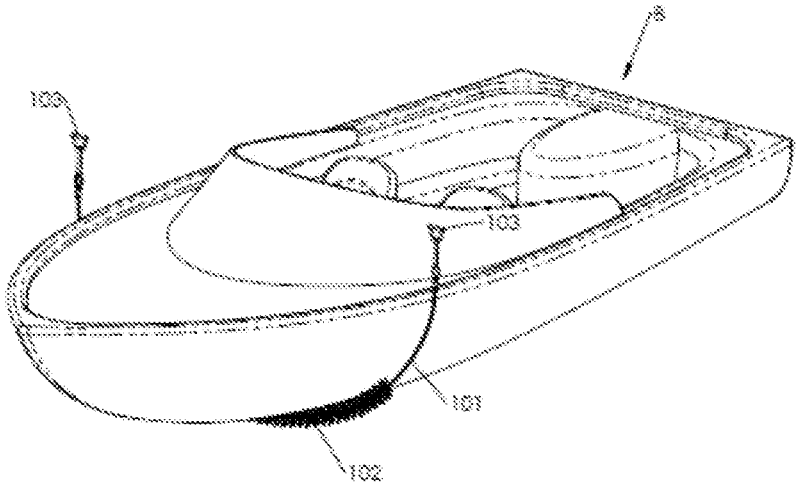
FIG. 7 depicts a perspective view of a boat while an embodiment of a device of the present invention is disposed beneath the hull of a boat.

One or more handles 103 may be added to the rope 101, preferably having one handle 103 disposed on each end of the length of rope 101 as depicted in FIGS. 1, 6, and 7. The handle 103 may be formed by any manner known within the art including but not limited to looping a piece of rope 101 back on itself and securing it thereto. This may be done at either end or both ends of the rope 101. Alternatively, the one or more handles 103 may also be formed by providing a protuberance in/on the rope 101 that may prevents the rope 101 from slipping through a user's hand, connecting a separate device to the rope 101, attaching a rigid bar attached to the rope 101 at either or both ends, and the like. The bar may be long enough to facilitate grasping the handle 103 with both hands. In one embodiment, such a handle 103 may be similar to handles commonly found on ski ropes. The handle 103 may also extend the length of the device and allow for adjustment of handle length or location of grasping surface. Such handles 103 are well known in the art.

Lead pellets, other negatively buoyant material, or the like may be disposed between the one or more strands 107 of the rope 101 and/or in the core 106 of the rope 101 either throughout the length of the rope 101 or in strategic and preferred locations of the rope 101 depending on the desired buoyancy characteristics. It may be beneficial to place the one or more weighted components 105 more densely toward the middle of the length of rope 101 and less densely toward the ends of the length of the rope 101. This may allow the middle section of the rope 101 to more easily sink so that it may facilitate positioning the device 100 beneath a boat B hull while the boat B is in the water (see FIGS. 6-7), while still allowing the ends of the device 100 to float so that it is not lost if accidentally dropped into the water. The buoyancy of the rope 101 may also assist in placing upward pressure of the filaments 102 against the bottom of the boat B. This increased upward pressure may further aid in cleaning the submerged hull.

FIGS. 6-7 depict the section of the rope 101 that contain the one or more filaments 102 placed in the water beneath a boat B. One or more users may pull the handles 103 alternately such that the one or more filaments 102 scrub the bottom of the boat B. In one embodiment of use, a single user may hold both of the handles 103 located on either end of the rope 101. In an alternate embodiment of use, two different users may manipulate the device 100. In such an embodiment, each user would hold a different handle 103. The plurality of users may move the one or more filaments 102 across the bottom surface of the boat B either laterally from port to starboard or from starboard to port. The plurality of users may also move the one or more filaments 102 across the bottom surface of the boat B longitudinally from bow to stern or from stern to bow.

While the above description contains much specificity, these should not be construed as limitations on the scope of any embodiment, but as exemplifications of the presently preferred embodiments thereof. Many other ramifications and variations are possible within the teachings of the various embodiments including non-aquatic applications of the present inventive versatile flexible scrubber device both with and without weights.

What is claimed is:

1. A scrubber device, comprising:

a rope having a first end, a second end, and an outer surface, said rope further comprising:

one or more weighted components;

a core, wherein said core is disposed about said one or more weighted components; and one or more strands, wherein said one or more strands are twisted or braided together about said core;

one or more filaments, wherein said one or more filaments extend outward from said outer surface of said rope, and a handle attached to said first end and/or said second end of rope.

2. The scrubber device as claimed in claim 1, wherein said one or more filaments further comprise one or more flagged ends thereon.

3. The scrubber device as claimed in claim 1, wherein said one or more filaments extend from said outer surface of said rope at an acute angle.

4. The scrubber device as claimed in claim 1, wherein said one or more filaments extend perpendicularly from said outer surface of said rope.

5. The scrubber device as claimed in claim 1, wherein said one or more filaments are secured to said rope with an adhesive.

6. The scrubber device as claimed in claim 1, wherein said one or more strands are comprised of polypropylene.

7. The scrubber device as claimed in claim 1, wherein said one or more filaments is comprised of polypropylene.

8. The scrubber device as claimed in claim 1, wherein each of said one or more filaments comprise a diameter in the range of 0.006 inches to 0.100 inches.

9. The scrubber device as claimed in claim 1, wherein each of said one or more filaments extend from said outer surface of said rope a distance in the range of 0.5 inches to 12.0 inches.

10. A scrubber device, comprising:

a rope having a first end, a second end, and an outer surface, said rope further comprising:

one or more weighted components;

a core, wherein said core is disposed about said one or more weighted components; and one or more strands, wherein said one or more strands are twisted or braided together about said core;

one or more filaments, wherein said one or more filaments extend outward from said outer surface of said rope, said one or more filaments further comprising one or more flagged ends thereon; and a handle attached to said first end and/or said second end of rope, wherein each of said one or more filaments comprise a diameter in the range of 0.006 inches to 0.100 inches, and wherein each of said one or more filaments extend from said outer surface of said rope a distance in the range of 0.5 inches to 12.0 inches.

* * * * *